United States Patent [19]

Rosenthal et al.

[11] 4,422,922

[45] Dec. 27, 1983

[54] COAL LIQUEFACTION AND HYDROPROCESSING OF PETROLEUM OILS

[75] Inventors: Joel W. Rosenthal, El Cerrito; Arthur J. Dahlberg, Rodeo, both of Calif.

[73] Assignee: Chevron Research Company, San Francisco, Calif.

[21] Appl. No.: 401,455

[22] Filed: Jul. 26, 1982

Related U.S. Application Data

[63] Continuation of Ser. No. 241,805, Mar. 9, 1981, abandoned, which is a continuation-in-part of Ser. No. 194,730, Oct. 6, 1980, Pat. No. 4,330,393, which is a continuation-in-part of Ser. No. 12,185, Feb. 14, 1979, Pat. No. 4,330,390, which is a continuation-in-part of Ser. No. 754,198, Dec. 27, 1976, Pat. No. 4,330,389.

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,705,092 | 12/1972 | Gatsis | 208/8 LE |
| 3,840,456 | 10/1974 | Tavorsky et al. | 208/10 |
| 3,884,796 | 5/1975 | Hinderliter | 208/8 LE |
| 3,925,188 | 12/1975 | Lester | 585/485 X |
| 3,966,584 | 6/1976 | Gray et al. | 208/131 X |
| 4,018,663 | 4/1977 | Karr | 208/10 |
| 4,032,428 | 6/1977 | Johnson | 208/10 X |
| 4,052,291 | 10/1977 | Epenscheid | 208/8 LE |
| 4,054,504 | 10/1977 | Chervenak et al. | 208/10 |
| 4,057,484 | 11/1977 | Malek | 208/8 LE |
| 4,110,192 | 8/1978 | Hildebrand et al. | 208/10 X |
| 4,111,786 | 9/1978 | Sugimura et al. | 208/8 LE |
| 4,111,788 | 9/1978 | Chervenak et al. | 208/10 |
| 4,214,977 | 7/1980 | Ranganathan et al. | 208/10 X |
| 4,309,269 | 1/1982 | Denker et al. | 208/8 LE |

FOREIGN PATENT DOCUMENTS

| | | | |
|---|---|---|---|
| 1073389 | 3/1980 | Canada | 196/146 |
| 77/7526 | 1/1979 | South Africa . | |

OTHER PUBLICATIONS

"Hydrocracking Athabasca Bitumen In the Presence of Coal Part 1: A Preliminary Study of the Changes Occurring in the Coal", Department of Energy, Mines and Resources, Mines Branch, Ottawa, Oct. 1974, Research Report R-276, M. Ternan et al.

"Hydrocracking of Athabasca Bitumen: Effect of Coal-Base Catalyst on Pilot Plant Operation", Canadian Center for Mineral & Energy Technology, Jan. 1977, Energy Research Program, Energy Research Laboratory, Canmet Report 77-35, C. P. Khulbe et al.

"A Comparative Study of Fe Catalysts, $ZnCl_2$ Catalysts and $ZnCl_2$-Promoted Fe Catalysts for Hydrocracking of Athabasca Bitumen", Canadian Center for Mineral & Energy Technology, Energy Research Program, Energy Research Lab., Canmet Report 77-50, W. A. O. Herrmann et al.

*Primary Examiner*—William G. Wright

*Attorney, Agent, or Firm*—D. A. Newell; S. R. La Paglia; S. H. Roth

[57] ABSTRACT

This invention comprises a process for hydroprocessing a petroleum oil containing soluble metals compounds while suppressing the accumulation of coke within the hydroprocessing zone, comprising the steps of (a) forming a mixture comprising particulate coal and a petroleum oil containing soluble metal compounds to form a feed slurry; and (b) contacting said feed slurry with added hydrogen in said hydroprocessing zone under hydroprocessing conditions to produce an effluent comprising a normally liquid portion having a reduced soluble metals concentration and undissolved solids containing metal from said soluble metals compounds in said petroleum oil.

10 Claims, 3 Drawing Figures

COAL LIQUEFACTION AND HYDROPROCESSING OF PETROLEUM OILS

CROSS REFERENCES TO RELATED APPLICATIONS

This application is a continuation of application Ser. No. 241,805, filed Mar. 9, 1981, now abandoned, which is a continuation-in-part of application Ser. No. 194,730, filed Oct. 6, 1980, now U.S. Pat. No. 4,330,393, which is a continuation-in-part of application Ser. No. 12,185, filed Feb. 14, 1979, now U.S. Pat. No. 4,330,390, which is a continuation-in-part of application Ser. No. 754,198, filed Dec. 27, 1976, now U.S. Pat. No. 4,330,389, the disclosures of which are incorporated by reference herein.

BACKGROUND OF THE INVENTION

1. Field of the Invention

The present invention relates to an improved process for the liquefaction of raw subdivided coal. More particularly, the invention relates to an improved liquefaction process wherein coal is dissolved in a petroleum-derived solvent at an elevated temperature. The dissolved coal can be hydrocracked at a lower temperature to produce acceptable fuel oils accompanied by minimum gas production.

2. Prior Art

Coal is our most abundant indigenous fossil fuel resource, and as a result of dwindling petroleum reserves, concerted research efforts are being directed towards recovery of liquid hydrocarbons from coal on a commercial scale. A promising approach in this field relates to the direct liquefaction of coal accompanied with minimum gas production. This approach has principally evolved from the early work of F. Bergius, who discovered that transportation fuels could be produced by the high-pressure hydrogenation of a paste of coal, solvent and catalyst. Later discoveries revealed the advantageous use of specific hydrogenation solvents at lower temperatures and pressures. With these solvents, such as partially saturated polycyclic aromatics, hydrogen is transferred from the solvent to the coal molecules, thus causing depolymerization and dissolution of the coal. The resulting coal liquid, however, has a high molecular weight and an accordingly high viscosity, which presents considerable obstacles to removing the fine coal residue remaining in the liquid, since these particles typically range in size from 1 to 25 microns in diameter. The complete nature of the coal residue, or undissolved solids, is not wholly understood; however, the residue appears to be a composite of organic and inorganic species. The residue organic matter is similar to coke, and the residue inorganic matter is representative of the well-known ash constituents. Removal of the residue from the coal liquid has been considered a critical step in the prior art in the preparation of clean fuels, particularly in those processes in which the coal liquids are subjected to catalytic upgrading, such as hydrocracking.

Nearly all crude petroleum stocks and especially crude residua contain metal compounds, but the amounts and types of metals may vary considerably depending upon the geographic and geological origin of the coal. These metal compounds are organo-metallics and are dissolved in the oil. Certain South American crudes, for example, contain large amounts of vanadium but only small amounts of other metals. Other crudes, for example, Middle Eastern, contain a broad spectrum of metals in only moderate concentrations, mostly metals such as nickel and vanadium, and smaller amounts of such metals as iron and sodium. Still other crudes, for example, California crudes, contain large amounts of many metals, including large amounts of iron and sodium. In the processing of petroleum feedstocks over fixed-bed hydrocracking catalysts to convert the higher-boiling fractions to lower-boiling fractions, it is generally recognized that a high metals content in the feed tends to rapidly foul the catalyst bed. The metal compounds present in the residua will form metalliferous deposits on and between catalysts in the bed and with the pores of the catalyst. The deposits on and between the catalyst particles may clog the catalyst bed, thereby restricting the oil throughput. Deposits within the catalyst pores result in an overall deactivation of the catalyst. It is therefore an object of this invention to provide a process for the liquefaction of coal with a petroleum feedstock having a relatively high metals content. The liquefaction products may be directly hydrocracked without substantial fouling of the catalyst bed.

SUMMARY OF THE INVENTION

In accordance with the present invention, there is provided a process for the liquefaction of coal wherein subdivided coal is substantially dissolved in a petroleum-derived solvent, for example, at a temperature between 400° and 480° C., thereby forming a mixture comprising solvent, dissolved coal, and insoluble solids. The mixture of the solvent, coal and insoluble solids is withdrawn from the dissolving zone and can be contacted in a reaction zone with hydrogen in the presence of an externally supplied hydrocracking catalyst under hydrocracking conditions. Preferably, the mixture is cooled before hydrocracking to a temperature below 425° C. and lower than the temperature at which the coal is dissolved. The normally liquid portion of the hydrocracked effluent stream has a specific gravity of less than 1, a low sulfur and nitrogen content and a low metals content.

The presence of the coal particles has been found to significantly inhibit coking of the petroleum-derived solvent. Furthermore, metals from the soluble metals compounds of the petroleum oil deposit upon the undissolved coal residue suspended in the liquid. The presence of ash-containing coal can substantially eliminate coke accumulation within the dissolver.

In one aspect, this invention comprises a process for hydroprocessing a petroleum oil containing soluble metal compounds while suppressing the accumulation of coke within the hydroprocessing zone, comprising:

(a) forming a mixture comprising particulate coal and a petroleum oil containing soluble metals compounds to form a feed slurry; and (b) contacting said feed slurry with hydrogen in a hydroprocessing zone under hydrogenation conditions to produce an effluent comprising a normally liquid portion having a reduced concentration of soluble metal compounds, said effluent further comprising undissolved solids containing metals from the soluble metal compounds in the petroleum oil.

Further in accordance with the present invention, the coal is dissolved in the presence of added hydrogen, e.g., at a pressure above 35 atmospheres. The weight ratio of petroleum-derived solvent to coal is normally maintained in the range 5:1 to 0.5:1 and said petroleum solvent comprises a crude fraction boiling above 200° C.

Preferably, sufficient coal is added to the petroleum-derived solvent to result in a concentration of coal ash within the dissolver of 0.2 to 6%, more preferably 0.3 to 4%, and most preferably, 0.3 to 1%.

The second stage hydrocracking reaction zone may comprise a fixed bed, moving bed, or ebullating bed of catalyst. The hydrocracking catalyst will preferably comprise a Group VIII and/or Group VI-B metal on a cracking support such as alumina.

DETAILED DESCRIPTION OF THE PREFERRED EMBODIMENTS

Figure 1:
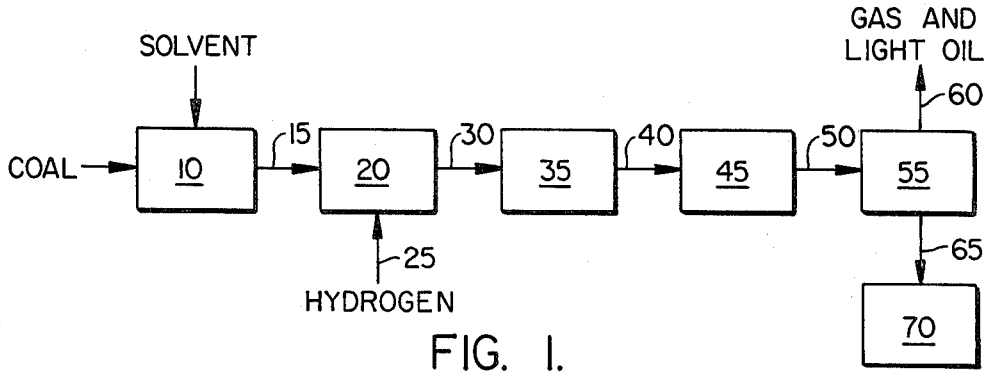
FIG. 1 is a block flow diagram of suitable flow paths for use in practicing one embodiment of the present invention.

In a preferred embodiment, comminuted coal is slurried with a petroleum-derived solvent boiling above 200° C. in a mixing zone 10. The effluent slurry from zone 10 passes to a dissolver 20, wherein the slurry is heated to dissolve at least 50 weight percent of the coal in the presence of added hydrogen, thereby forming a mixture of solvent, dissolved coal and coal residue. The mixture from dissolver 20 is cooled if desired in zone 35 to a temperature lower than the temperature of the dissolver and preferably, at least below 425° C. The cooled mixture is then hydrocracked in zone 45 to produce a relatively low-viscosity liquid product which may be readily separated from any remaining coal residue.

Referring to FIG. 1 in detail, subdivided coal is mixed with a petroleum solvent in mixing zone 10. The basic feedstock for the present invention is a solid subdivided coal such as anthracite, bituminous coal, sub-bituminous coal, lignite, or mixtures thereof. The bituminous and sub-bituminous coals are particularly preferred, and it is also preferred that said coals be ground to a particle size smaller than 100 mesh, Tyler Standard Sieve Size, although larger coal sizes may be processed. The solvent will typically comprise partially hydrogenated polycyclic aromatic hydrocarbons, generally one or more rings at least partially saturated. Examples of such materials are tetrahydronaphthalene, dihydronaphthalene, dihydroanthracene, and similar materials. Such solvents may be obtained from numerous materials, but it is particularly preferred to use a 200° C. or higher-boiling petroleum fraction, such as a topped naphthenic crude or a vacuum residua. Asphaltic or napthenic crudes are generally higher in aromatics and naphthenes in comparison to paraffinic base crudes. As a result, such crudes are preferable over the paraffinic crudes for use as solvents in the present invention. Such crudes are also usually higher in sulfur, nitrogen and metals than paraffinic crudes and thus greater problems in refining processes than said crudes. The process of the present invention, however, is capable of tolerating the higher metals content in the hydrocracking zone without prior demetallation or pretreatment precautions.

The subdivided coal is mixed with the solvent in a solvent-to-coal weight ratio from about 0.5:1 to 5:1, and preferably from about 1:1 to 3:1. From mixing zone 10, the slurry is fed or pumped through line 15 to a dissolving zone 20, wherein the slurry is heated, preferably in the presence of added hydrogen, for example, to a temperature in the range of 400° C. to 480° C., preferably 425° C. to 455° C., for a length of time sufficient to substantially dissolve the coat. At least 50 weight percent, and preferably greater than 90 weight percent of the coal, on a moisture- and ash-free basis, is dissolved in zone 20, thereby forming a mixture of solvent, dissolved coal and insoluble solids, or coal residue. It is usually necessary that the slurry be heated to at least 400° C. to obtain a 50% dissolution of the coal. Further, it is usually required that the coal slurry not be heated to temperatures above 480° C. to prevent excessive thermal cracking, which substantially reduces the overall yield of normally liquid products.

Hydrogen is also introduced into the dissolving zone through line 25 and normally comprises fresh hydrogen and recycle gas. Other reaction conditions in the dissolving zone include, for example, a residence time of 0.01 to 3 hours, preferably 0.1 to 1 hour; a pressure in the range of 35 to 680 atmospheres, preferably 100 to 340 atmospheres; and a hydrogen gas rate of 355 to 3550 liters per liter of slurry and preferably 380 to 1780 liters per liter of slurry. Preferably, the dissolving zone is operated in the absence of externally provided carbon monoxide, however, small amounts of carbon monoxide may be present in internally recycled gas to the dissolving zone. The physical structuring of the dissolving zone is such that the slurry may flow upwardly or downwardly in said zone. Preferably, the zone is sufficiently elongated to attain plug flow conditions, which permits the process of the present invention to be practiced on a continuous basis.

The dissolving zone preferably contains no catalyst from any external source, although the mineral matter contained in the coal has some catalytic effect. Finely divided catalysts such as ammonium molybdate, spent FCC catalyst fines, pulverized supported catalysts, metal sulfides such as $MoS_2$, $FeS_2$, etc., can be added if desired. Preferably, however, no supported catalysts from an external source are present in the dissolving zone.

The effluent from the dissolving zone is a slurry comprising undissolved solids and a normally liquid product having a reduced concentration of soluble metal compounds. The undissolved coal residue solids contain deposited metals or metal values from the soluble metals compounds present in the petroleum oil. These solids can be separated from the dissolving zone effluent to provide a hydrodemetalized oil suitable for further catalytic upgrading, e.g., fluid catalytic cracking or hydroprocessing.

Preferably, the dissolving zone effluent or a portion thereof is fed directly into a catalytic hydrogenation zone, without solids separation. If cooling is desired, the mixture of solvent, dissolved coal and insoluble solids from dissolver 20 passes via line 30 to cooling zone 35. Cooling zone 35 will typically contain a heat exchanger or similar means whereby the effluent from dissolver 20 is cooled to a temperature below the temperature of the dissolving stage and preferably at least below 425° C. Some cooling in zone 35 may also be effected by the addition of fresh cold hydrogen, if desired. The cooled mixture of solvent, dissolved coal, insoluble solids and hydrogen is fed through line 40 into reaction zone 45 containing a hydrocracking catalyst. In the hydrocracking reaction zone, hydrogenation and cracking occur simultaneously and the higher-molecular-weight compounds are converted to lower-molecular-weight compounds; the sulfur in the sulfur compounds is converted to hydrogen sulfide; the nitrogen in the nitrogen compounds is converted to ammonia; and the oxygen in the oxygen compounds is converted to water. Preferably, the catalytic reaction zone is a fixed-bed type, but an ebullating or moving bed may also be used. The mixture of gases, liquids and insoluble solids preferably passes upwardly through the catalytic reaction zone, but may also pass downwardly.

The catalyst used in the hydrocracking zone may be any of the well-known commercially available hydrogenation or hydrocracking catalysts. A suitable catalyst for use in the hydrocracking reaction stage comprises a hydrogenation component and a cracking component. Preferably, the hydrogenation component is supported on a refractory cracking base. Suitable bases include, for example, silica, alumina, or composites of two or more refractory oxides such as silica-alumina, silica-magnesia, silica-zirconia, silica-boria, silica-titania, silica-zirconia-titania, acid-treated clays, and the like. Acidic metal phosphates such as alumina phosphate may also be used. Preferred cracking bases comprise alumina and composites of silica and alumina. Suitable hydrogenation components are selected from Group VI-B metals, Group VIII metals, and their oxides, or mixtures thereof. Particularly useful are cobalt-molybdenum, nickel-molybdenum, or nickel-tungsten on alumina or silica-alumina supports.

It is preferred to maintain the temperature in the second stage hydrocracking zone below 425° C., preferably in the range 340° C. to 425° C., and more preferably 340° C. to 400° C., to prevent rapid catalyst fouling. The temperature in the second stage hydrocracking zone should be preferably maintained below the temperature in the dissolving zone by 55° to 85° C. Other hydrocracking conditions include, for example, a pressure from 35 to 680 atmospheres, preferably 70 to 200 atmospheres; a hydrogen rate of 355 to 3550 liters per liter of slurry, preferably 380 to 1780 liters per liter of slurry; and a slurry-liquid hourly space velocity in the range 0.1 to 2, preferably 0.2 to 0.5.

Preferably, the pressures in the noncatalytic dissolving stage and the catalytic hydrocracking stage are maintained substantially equal.

Preferably, the entire effluent from the dissolver is passed to the hydrocracking zone. However, since small quantities of water and light gases ($C_1$–$C_4$) are produced in the dissolver, the catalyst in the second stage is subjected to a lower hydrogen partial pressure than if these materials were absent. Since higher hydrogen partial pressures tend to increase catalyst life, it may be desired in a commercial operation to remove a portion of the water and light gases before the stream enters the hydrocracking stage. Furthermore, interstage removal of the carbon monoxide and other oxygen-containing gases may reduce the hydrogen consumption in the hydrocracking stage due to reduction of the carbon oxides. The product effluent 50 from reaction zone 45 may be separated into a gaseous fraction 60 and a solids-liquid fraction 65 in zone 55. The gaseous fraction comprises light oils boiling below about 65° C. to 130° C. and normally gaseous components such as hydrogen, carbon monoxide, carbon dioxide, water and the $C_1$–$C_4$ hydrocarbons. Preferably, the hydrogen is separated from the other gaseous components and recycled to the hydrocracking or dissolving stages. The liquid-solids fraction 65 may be fed to solids separation zone 70 wherein the insoluble solids are separated from the liquid by conventional means, for example, hydroclones, filters, centrifugal separators, cokers and gravity settlers, or any combination of said means in zone 70.

It has also been found according to this invention that the degree of hydrodemetalation occurring in the dissolving zone is dependent upon the concentration of coal ash present in the dissolving zone. A significant enhancement in hydrodemetalation is obtainable at 0.2 to 6% by weight ash. If the amount of coal or solids in the system is to be minimized, excellent hydrodemetalation occurs with 0.3 to 4 or 0.3 to 1 weight percent coal ash in the dissolving zone.

The advantages of the present invention will be readily apparent from consideration of the following examples.

EXAMPLE 1

A slurry consisting of 33 weight percent River King coal and 67 weight percent topped Ken River crude was passed sequentially through a first stage dissolving zone and a second stage hydrocracking zone in the presence of added hydrogen. The coal was ground to a particle size of 100 mesh (Tyler standard sieve) and had the following analysis on a weight percent dry basis: carbon, 59%; hydrogen, 4.14%; nitrogen, 1.14%; oxygen, 11.03%; sulfur, 4.36%; ash, 20.33%. The crude solvent comprised a 200° C.+ fraction having the following characteristics: specific gravity, 0.977; saturates, 37.3 weight percent; aromatics, 59.2 weight percent; sulfur compounds, 3.5 weight percent; metals: nickel, 67 ppm; vanadium, 33 ppm; iron, 27 ppm; a thermal gravimetric analysis (TGA) is given below for comparison with the $C_4$+ product effluent. Hydrogen was introduced into the dissolver at a rate of 1780 $m^3/m^3$ of slurry. The slurry had a residence time of approximately one hour in the dissolver which was maintained at a pressure of 163 atmospheres and a temperature of 455° C. The effluent mixture of gases, liquids and solids was passed to the second stage which was maintained at 163 atmospheres and 400° C. The second stage contained a fixed bed of hydrocracking catalyst comprising 10 weight percent nickel and 24 weight percent tungsten in an alumina base. A space velocity in the hydrocracking stage was maintained at 0.38/hour based upon the feed slurry and a hydrogen consumption rate of 349 cubic meters per cubic meter of $C_4$+ product was observed. The hydrocracker effluent had the following properties:

| Product Distribution | Weight Percent |
|---|---|
| $C_1$–$C_3$ | 5.4 |
| $C_4$+ liquid | 86.8 |
| Unreacted coal | 2.8 |
| $H_2S$, $NH_3$, $H_2O$, $CO_x$ | 7.7 |

The $C_4$+ liquid product had a specific gravity of 0.898, a sulfur content of 0.02 weight percent, and a nitrogen content of 0.23 weight percent. Thermal gravimetric analyses of $C_4$+ liquid are shown in Table 1 in comparison to the thermal gravimetric analysis of the Kern River crude.

TABLE 1

| Fraction | Liquid Product Effluent | Kern River Crude |
|---|---|---|
| $C_4$–200° C. | 18.7 | — |
| 200°–345° C. | 46.2 | 16.4 |
| 345°–540° C. | 30.5 | 45.0 |
| 540° C.+ | 4.5 | 38.0 |

EXAMPLE 2

Arabian Heavy atmospheric resid containing by weight 24 ppm nickel, 82 ppm vanadium, 4.6% S, 0.22% N, and 55.2% 538° C.+ was hydroprocessed at 440° C. and a slurry hourly space velocity of 1 $hour^{-1}$ in a single-stage reactor operated at 163 atmospheres and a hydrogen gas rate of 1780 $m^3/m^3$. The results are shown in Table 2.

TABLE 2

| Feed Coal/ Resid (Wt %) | Apparent Coal Conversion, % MAF | 538° C.+ to 538° C.− Conversion, % | $C_1$–$C_3$ Production, % Total MAF | Whole Liquid Product Inspections Wt % S | N | Ni ppm | V ppm | $C_7$ Insolubles Wt % |
|---|---|---|---|---|---|---|---|---|
| 0/100[1] | — | 68.8 | 3.7 | 3.54 | 0.18 | 7 | 18 | 4.4 |
| 5/95 | 62.2[2] | 67.3 | 2.3 | 2.67 | 0.31 | 13 | 13 | 3.6 |
| 25/75 | 65.3[2] | 59.7 | 3.0 | 2.53 | 0.48 | 9 | 9 | 5.9 |
| 33⅓:66⅔ | 66.7[2] | — | 3.3 | Product unstable - only coal conversion and gas make results obtained. | | | | |
| | 86.2[3] | | | | | | | |

[1]Coking plugged system 40 hours into run.
[2]EtOAC - Soluble conversion.
[3]Pyridine - Soluble conversion.

Figure 2:
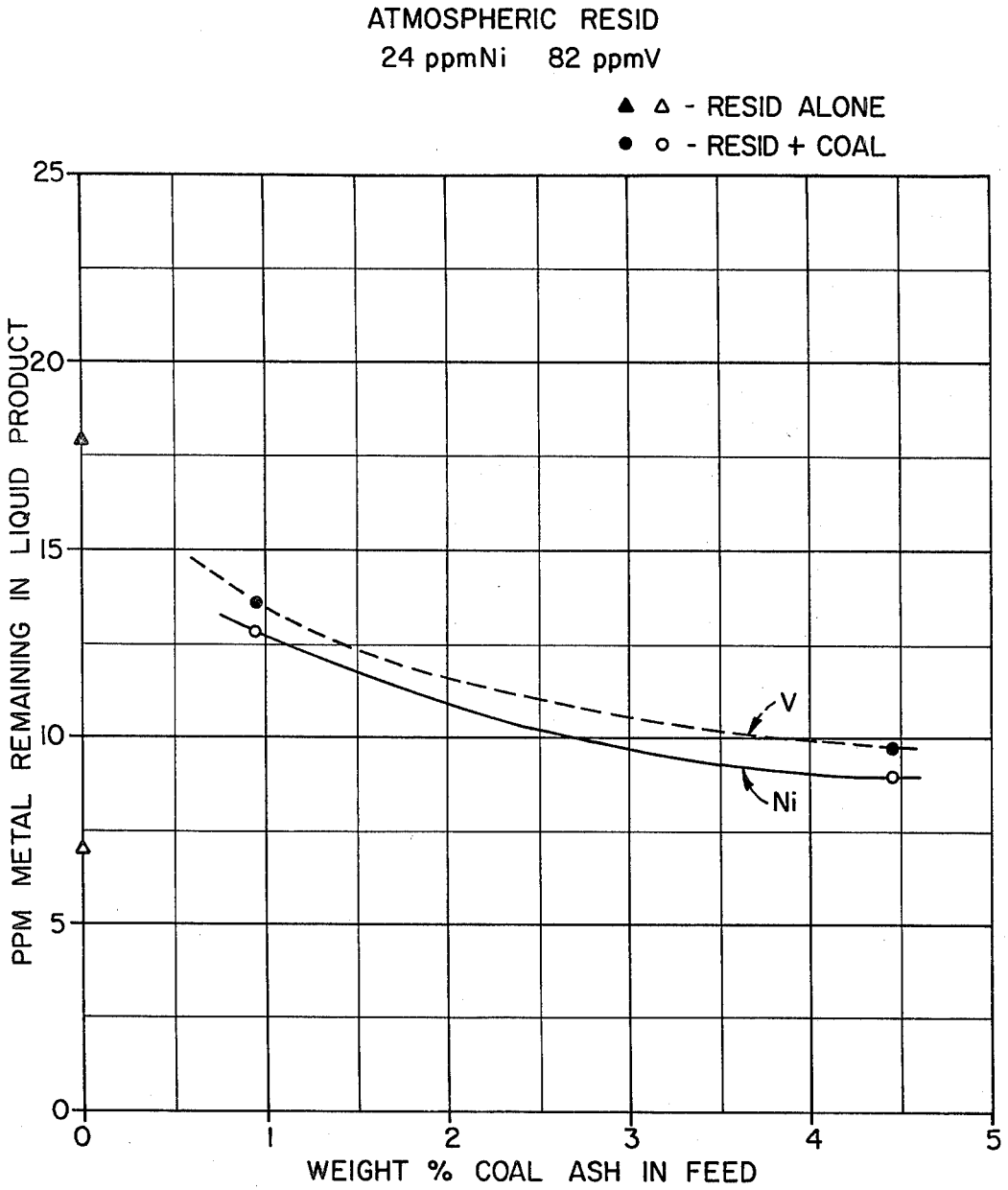
FIG. 2 is a graph of the metals content of liquid products from one-stage thermal hydroprocessing of atmospheric petroleum residuum, as a function of the coal ash content of the feed.

FIG. 2 depicts the variation in demetalation as a function of the weight percent ash in the coal/residium feed to the reactor.

EXAMPLE 3

Crude petroleum from Kern County, California containing by weight 63 ppm nickel, 34 ppm vanadium, 1.01% S, 0.71% N, and 38% 538° C.+ was hydroprocessed at 440° C. and a slurry hourly space velocity of 1 $hour^{-1}$ in a single-stage reactor operated at 163 atmospheres and a hydrogen gas rate of 1780 $m^3/m^3$. The results are shown in Table 3.

TABLE 3

| Feed Coal/ Resid (Wt %) | Apparent Coal Conversion, % MAF | 538° C.+ to 538° C.− Conversion, % | $C_1$–$C_3$ Production, % Total MAF | Whole Liquid Product Inspections Wt % S | N | Ni ppm | V ppm | $C_7$ Insolubles Wt % |
|---|---|---|---|---|---|---|---|---|
| 0/100[1] | — | 68.8 | 3.2 | 0.77 | 0.73 | 36 | 13 | 2.9 |
| 5/95 | 63.7[4] | 61.2 | 2.5 | 0.58 | 0.79 | 25[2] | 6[2] | 3.1 |
| 15/85 | 70.2[4] | 59.8 | 2.1 | 0.54 | 0.69 | 16 | 5 | 3.8 |
| 25/75 | 80.8[4] | 41.3[3] | 2.3 | 0.66 | 0.83 | 7 | 5 | 5.2 |

[1]Coking plugged system 50 hours into run.
[2]Other analysis: Ni/V, ppm = 20/6.
[3]538° C.+ to 538° C.− conversion varied between 40% and 50%.
[4]EtOAc - Soluble conversion.

Figure 3:
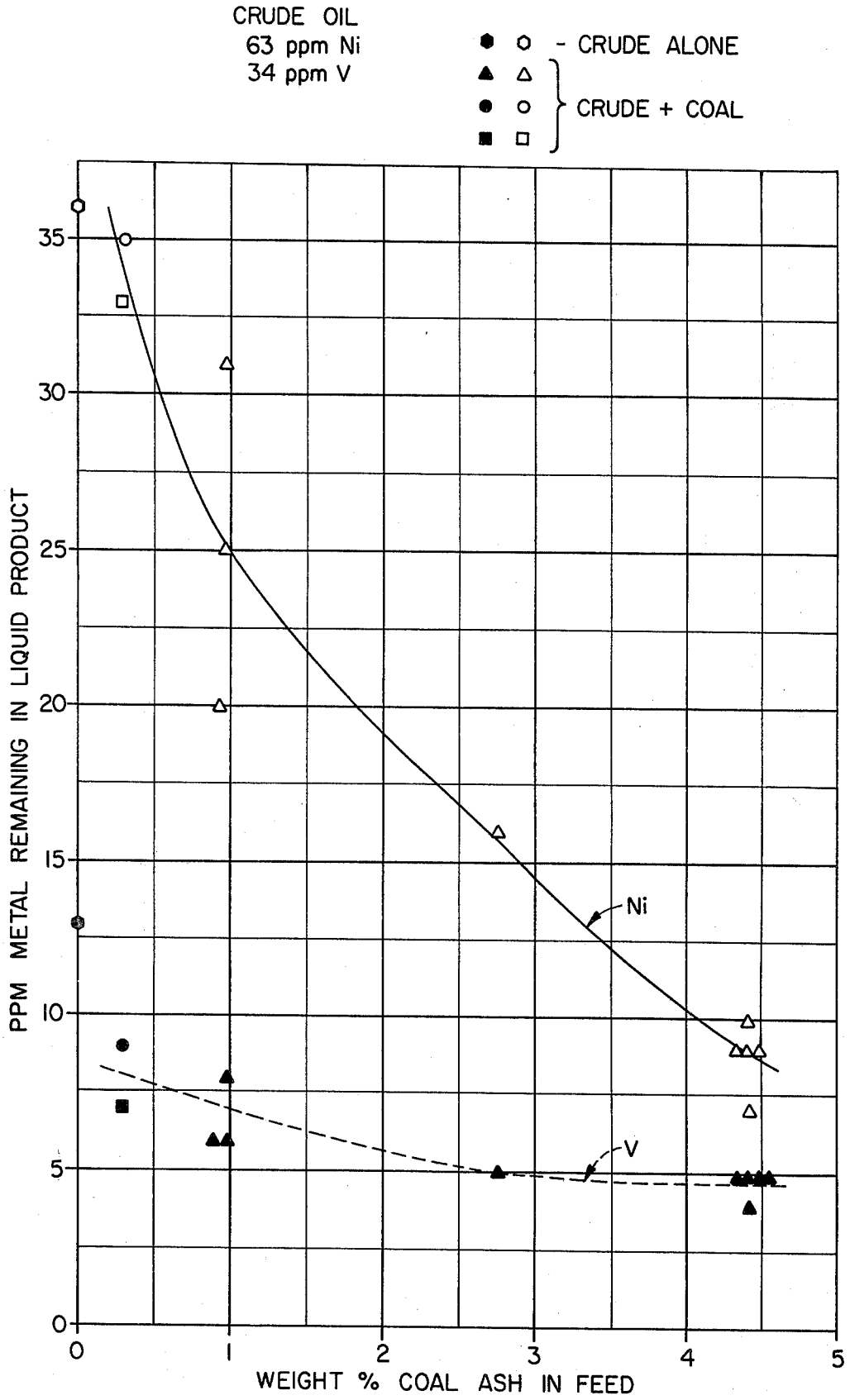
FIG. 3 is a graph of the metals content of liquid products from one-stage thermal hydroprocessing of crude petroleum, as a function of the coal ash content of the feed.

FIG. 3 depicts the variation in demetalation as a function of the weight percent ash in the coal/crude feed to the reactor and processed as in Example 3 for similar runs employing three types of coal.

It will be apparent to those skilled in the art that this invention can be practiced using a wide variety of coals and a wide variety of petroleum oils containing soluble metal compounds. The process of this invention is particularly advantageous when the coal/petroleum oil mixtures are hydroprocessed under hydroprocessing conditions which would cause coking of the petroleum oil in the absence of the coal, thereby resulting in undesirable coke accumulations within the reactor.

We claim:

1. A process for obtaining enhanced demetallation of a petroleum oil containing soluble metal compounds during the hydroprocessing of the oil in a hydroprocessing zone and substantially eliminating the accumulation of coke in said zone comprising:

(a) forming a mixture consisting essentially of petroleum oil containing soluble metal compounds and particulate coal to form a feed slurry so as to provide a concentration of coal ash in the hydroprocessing zone of from about 0.2 to 6% by weight; and (b) contacting the feed slurry with added hydrogen in the hydroprocessing zone in the absence of externally supplied catalyst under hydroprocessing conditions under which coke would tend to accumulate in the absence of the coal to dissolve at least 50% of the coal on a moisture- and ash-free basis to produce an effluent comprising a normally liquid portion having an enhanced reduction in soluble metals concentration and an undissolved solids portion containing metals from the petroleum oil whereby accumulation of coke in the hydroprocessing zone is substantially eliminated.

2. A process according to claim 1 wherein said hydroprocessing conditions include a temperature in the range of 400° to 480° C., a pressure in the range of 35 to 680 atmospheres, a residence time of 0.01 to 3 hours, and a hydrogen gas rate of 355 to 3550 liters per liter of slurry.

3. A process according to claim 1 wherein said hydroprocessing conditions include a temperature in the range of 425° to 455° C., a pressure in the range of 100 to 340 atmospheres, a residence time of 0.1 to 1 hour, and a hydrogen gas rate of 380 to 1780 liters per liter of slurry.

4. A process according to claim 1 wherein said feed slurry contains sufficient coal to provide a concentration of coal ash in said hydroprocessing zone of 0.3 to 4% by weight.

5. A process according to claim 1 wherein said feed slurry contains sufficient coal to provide a concentration of coal ash in said hydroprocessing zone of 0.3 to 1% by weight.

6. A process according to claim 1 wherein said petroleum oil comprises crude petroleum or an asphaltic crude fraction boiling above 200° C.

7. A process according to claim 1 wherein at least about 90 percent by weight of said coal on a moisture- and ash-free basis is dissolved in said hydroprocessing zone.

8. A process according to claim 1 wherein said hydroprocessing is performed in the absence of externally supplied carbon monoxide.

9. A process according to claim 1 wherein said coal is raw coal.

10. A process according to claim 1 wherein said hydroprocessing conditions include a residence time of from 0.1 to 1 hour.

* * * * *